United States Patent [19]

Kawaguchi et al.

[11] 3,975,571

[45] Aug. 17, 1976

[54] SELF-BONDING MAGNET WIRE

[75] Inventors: Munetaka Kawaguchi, Nagoya; Yoshinobu Ueba, Osaka, both of Japan

[73] Assignee: Sumitomo Electric Industries, Ltd., Osaka, Japan

[22] Filed: Oct. 28, 1975

[21] Appl. No.: 626,002

[30] Foreign Application Priority Data

Oct. 25, 1974 Japan ..... 49-123758

[52] U.S. Cl. ..... 428/371; 427/116; 427/117; 427/118; 428/377; 428/383; 428/474

[51] Int. Cl.[2] ..... H01B 3/30; H01F 5/06

[58] Field of Search ..... 428/474, 900, 371, 369, 428/377, 383, 379; 427/116, 117, 118; 174/120 SR

[56] References Cited

UNITED STATES PATENTS

| | | | |
|---|---|---|---|
| 3,220,882 | 11/1965 | Lavin et al. | 428/474 X |
| 3,300,843 | 1/1967 | Umewaka et al. | 427/118 X |
| 3,446,660 | 5/1969 | Pendleton | 428/900 X |
| 3,516,858 | 6/1970 | Fitzhuga et al. | 428/383 |
| 3,553,011 | 1/1971 | Gunji et al. | 428/379 X |
| 3,632,400 | 1/1972 | Preston | 428/900 X |
| 3,762,986 | 10/1973 | Bhuta et al. | 156/331 X |
| 3,906,139 | 9/1975 | Hiraoka et al. | 428/383 |
| 3,922,465 | 11/1975 | Kawaguchi et al. | 428/383 |

*Primary Examiner*—Harris A. Pitlick
*Attorney, Agent, or Firm*—Sughrue, Rothwell, Mion, Zinn & Macpeak

[57] ABSTRACT

A self-bonding magnet wire comprising a conductor and a baked mixture of nylon copolymer (A) and nylon copolymer (B) where the proportion of nylon copolymer (A) and nylon copolymer (B) is 50–95 parts of (A) to 50 to 5 parts of (B) (by weight), nylon copolymer (A) being alcohol-insoluble and non-swellable by an alcohol at room temperature and containing nylon-12, and nylon copolymer (B) having a lower melting point than that of nylon copolymer (A). Yoke coils for television sets comprising such a magnet wire and a process for forming such a magnet wire are also disclosed.

11 Claims, No Drawings

SELF-BONDING MAGNET WIRE

BACKGROUND OF THE INVENTION

1. Field of the Invention:

This invention relates to a novel self-bonding magnet wire.

2. Description of the Prior Art:

Heretofore, yoke coils used in television sets have been produced by winding wire into a coil shape, subjecting the coil to rapid heating to activate a bonding layer on the wire and pressing the coil into its final shape while the bonding layer is still hot. In such a process, a self-bonding magnet wire having a heat-activated layer on the top of an insulating layer is employed. Heretofore, polyvinyl butyral, alcohol-soluble nylons or the like have been employed as self-bonding layers for self-bonding magnet wires.

In view of the requirements of broadened deflection angles, however, it has recently been desired to minimize the heat distortion of coils and the deformation of coils due to moisture absorption and to maintain adhesion even at high temperatures of about 130°C. With known self-bonding magnet wires using polyvinyl butyrals, alcohol-soluble nylons or the like as a bonding layer, the polyvinyl butyrals show poor resistance to thermal deformation and the nylons inhibit a magnet wire from being smoothly supplied in an automatic winding machine as they give the wires a tacky surface which tends to stick to the bobbin in the winding machine or become tacky due to moisture absorption during storage.

To eliminate the above disadvantages, it has been proposed to add thermosetting resins such as polyester resins, epoxy resins, phenol resins or the like, or these thermosetting resins in combination with hardening agents such as blocked isocyanates or the like, to alcohol-soluble nylons.

For example, the manufacture of a coil-forming insulated electric wire coated with an alcohol-soluble insulating material comprising an alcohol-soluble copolyamide resin and a thermosetting synthetic resin is disclosed, e.g., in U.S. Pat. No. 3,553,011. The conventional coating layer obtained according to this patent however, includes a portion of thermosetting resin which remains unchanged, which is alcohol-soluble, and thus it has poor toughness and resistance against chemicals and is not suited for yoke coils used in television sets, since the step of immersing in alcohols is required at the time of forming a coil.

Furthermore, such reactive varnishes either lose their fusibility if heating is conducted to avoid tackiness of the wires to bobbins, or require high fusion temperatures. As a result, it is difficult to provide products of uniform quality. Further even a self-bonding magnet wire in which tackiness to bobbins is prevented under ordinary conditions as above still becomes tacky under conditions of high temperature and high humidity. Therefore, after the wire is shaped into a coil, deformation thereof by heating or moisture absorption is significant. Accordingly, the requirement of high reliability of deflecting coils has not yet been satisfied.

In order to prevent tackiness of wires to bobbins, it has also been proposed to add acrylonitrile-styrene copolymer resins or polyhydroxy-polyether resins to alcohol-soluble nylons. However, adhesion decreases as compared to the use of nylon alone, and such cannot be considered an acceptable solution to the deformation problems due to heating and moisture absorption.

In order to overcome the above problems, we intensively investigated polyamide resins for forming a bonding layer for a self-bonding magnet wire suitable for use in deflecting coils for television sets.

When we used homopolyamides such as nylon-6, nylon-6,6, etc., the bonding temperature had to be kept too high because homopolyamides of a high melting point are needed. Bonding effected at such a high temperature, however, not only accelerated thermal degradation of the polyamide resins but also of the insulating underlayer if a material of poor heat stability was used therefore. Even nylon-12 which has the lowest melting point among the homopolyamide resins available on an industrial scale requires an undesirably high bonding temperature. Further, if these homopolyamide resins were blended, the desired bonding at low temperatures could not be realized.

However, we found that with a nylon copolymer containing nylon-12, bonding could be obtained at lower temperatures than with nylon-12, and strong adhesion can be obtained even at high temperatures, e.g., 130°C.

Of the nylon copolymers containing nylon-12, however, alcohol-soluble nylons were tacky and apt to cause adhesion of the wire to bobbins, and showed serious heat distortion after the wires were shaped into coils. Hence, they were not suitable as resins for a self-bonding layer. Accordingly, nylon copolymers containing nylon-12 which are capable of providing a self-bonding magnet wire free of tackiness to bobbins and exhibiting good bond strength at high temperatures must be alcohol-insoluble. However, such nylon copolymers were still insufficient in bonding at low temperatures.

In order to obtain bonding at low temperatures using nylon copolymers containing nylon-12, we contemplated blending thermoplastic resins other than nylons, which are capable of bonding at lower temperatures than the nylon copolymers, e.g., polyvinyl butyrals, polyesters, polyether esters, etc. However, if the thermoplastic resins were added in an amount sufficient to lower the bonding temperature, not only was the bond strength at high temperature lost but also resin compatibility was sometimes lost to deteriorate the physical properties of the nylon copolymers per se. Self-bonding magnet wires having such nylon copolymers as a self-bonding layer lost the excellent abrasion resistance and resistance to deterioration in processing which the nylon resins possess.

SUMMARY OF THE INVENTION

Therefore, one object of the present invention is to provide a self-bonding magnet wire which, when shaped into a coil, is excellent in resistance against deformation due to heating and moisture absorption.

Another object of the present invention is to provide a self-bonding magnet wire which has high reliability and is free of deterioration in processing.

Still another object of the present invention is to provide a self-bonding magnet wire which does not exhibit tackiness to bobbins.

A further object of the present invention is to provide a self-bonding magnet wire which can be bonded at a relatively low temperature in a short period of time, and having an excellent bond strength at high temperatures.

We found in accordance with the present invention that when nylon copolymers having a melting point lower than that of the heretofore mentioned alcohol-insoluble nylon copolymers are blended with an alcohol-insoluble nylon copolymer, it is possible to bond at relatively low temperatures, e.g., 150° to 160°C, without deteriorating any of the preferred physical properties which the nylon resins in general possess (such as tensile strength, elongation, toughness etc.) and, in addition, the blend exhibits excellent adhesion which is maintained even at high temperatures, e.g., 130°C., and a self-bonding magnet wire free of tackiness to bobbins is obtained.

DETAILED DESCRIPTION OF THE INVENTION

More specifically, the self-bonding magnet wire of the present invention is provided with a bonding layer which comprises, as the main component; a mixture of nylon copolymer (A) and nylon copolymer (B), where the proportion of (A) and (B) is 50–95 parts of (A) to 50 to 5 parts of (B) (by weight), if nylon copolymer (A) is insoluble in and non-swellable by alcohols, e.g., methanol, ethanol, propanol or isopropanol at room temperature, and contains nylon-12, and nylon copolymer (B) has a lower melting point than that of nylon copolymer (A), such a self-bonding magnet wire does not exhibit any tackiness to bobbins and permits bonding at low temperatures in a short period of time (from a few seconds to scores of seconds in the case of current heating and from about 5 minutes to about 30 minutes in the case of oven heating) and further shows excellent bond strength at high temperatures, e.g., 130°C.

In addition, the self-bonding magnet wire of the present invention, even when shaped into a coil, shows little deformation due to heating and moisture absorption and exhibits excellent heat distortion resistance and excellent resistance to deformation due to moisture absorption.

In spite of possessing a strong bond strength at high temperatures, the self-bonding magnet wire of the present invention permits bonding at relatively low temperatures, e.g., 150°C to 160°C. Accordingly, even if conventional polyurethanes, polyesters, etc., are employed as an insulating layer, no serious decrease in the characteristic properties of the insulating layer due to heating upon bonding are encountered. In particular, in the case of using insulating materials having heat stability above class F as an insulating layer, e.g., the heat stable polyester-imides, polyamide-imides, polyhydantoins, polyimides or multilayered structures thereof, etc., all of which show high heat stability, superior effect are exhibited. That is, even if pressure-forming after high speed winding. rapid heating by passage of an electric current or quenching is conducted, a self-bonding magnet wire having high reliability is obtained without any deterioration in processing, layer short circuiting or a decrease in the characteristic properties of self-bonding magnet wires.

However, unlike blends comprising alcohol-soluble nylons as a main component, the self-bonding coating for a self-bonding magnet wire in accordance with the present invention does not result in a lowering of the excellent characteristic properties which nylon copolymer resins possess. In addition, the self-bonding magnet wire shows excellent solvent resistance because it is insoluble or substantially insoluble in alcohols, and further, it is less hygroscopic so that it is free from tackiness to bobbins caused by moisture absorption, any decrease in adhesion of coils obtained by molding thereof, deformation due to expansion or swelling, etc., which are observed in self-bonding magnet wires using alcohol-soluble nylons.

In the present invention, it is preferred to use, as nylon copolymer (A), which is insoluble in and non-swellable by alcohols and which contains nylon-12, nylon copolymers obtained by copolymerizing laurolactum or polylaurolactam with other polyamide-forming monomers, e.g., polyamide copolymers obtained from laurolactam and ϵ-caprolactam (nylon-12-nylon-6), polyamide copolymers obtained from laurolactam and hexamethylene diammonium adipate (nylon-12-nylon-6,6), polyamide copolymer obtained from laurolactam and hexamethylene diammonium sebacate (nylon-12-nylon-6,10) and the like, containing laurolactam in a proportion of 60 to 90%, more preferably, 75 to 85% and most preferably 80%, by weight based on the total copolymer weight (hereafter all percentages are percents by weight, unless otherwise indicated).

Examples of nylon copolymer (B) which has a lower melting point than that of nylon copolymer (A) include nylon-6-nylon-6,6-nylon-6,10 copolymers, nylon-6-nylon-6,6-nylon-12 copolymers, nylon-6-nylon-6,10-nylon-12 copolymers, nylon-6-nylon-6,6-nylon-6,10-nylon-12 copolymers, etc.

It is preferred to use a nylon copolymer containing nylon-12 at a proportion of 10 to 50%, obtained by copolymerizing nylon-12 with one or more monomer components selected from nylon-6, nylon-6,6, nylon-6,10, etc. where 10 to 50% of nylon-12 is present in the copolymer.

Examples of nylon copolymer (B) which has a lower melting point than that of nylon copolymer (A) include two-, three- or higher component copolymers, e.g., polyamide copolymers obtained from ϵ-caprolactam, hexamethylene diammonium adipate and hexamethylene diammonium sebacate (nylon-6-nylon-6,6-nylon-6,10), polyamide copolymers obtained from ϵ-caprolactam, hexamethylene diammonium adipate and polylaurolactam (nylon-6-nylon-6,6-nylon-12), polyamide copolymers obtained from ϵ-caprolactam, hexamethylene diammonium adipate and polylaurolactam, polyamide copolymers obtained from ϵ-caprolactam, hexamethylene diammonium adipate, hexamethylene diammonium sebacate and polylaurolactam (nylon-6-nylon-6,6-nylon-6,10-nylon-12) etc. It is preferred to use a nylon copolymer containing laurolactam or polylaurolactam at a proportion of 10 to 50%, obtained by copolymerizing laurolactam or polylaurolactam with one or more other polyamide-forming monomers where 10 to 50% laurolactam or polylaurolactam is present in the copolymer. Preferred examples are nylon-6-nylon-6,6-nylon-12, nylon-6-nylon-6,10-nylon-12 etc. It is most preferred to use nylon-6-nylon-6,6-nylon-12as nylon copolymer (B), when the aforementioned nylon-12-nylon-6 is employed as nylon copolymer (A). All percentages given above are based on total copolymer weight.

It is commercially preferred to carry out baking under conditions of a temperature of about 250°C to about 400°C, at a linear oven velocity of about 5m to about 20 m/min. under atmospheric pressure using an oven having an oven length of about 4 m. Usually baking is conducted in air and the time of baking is a function of oven length and linear velocity.

Further, if desired, thermosetting resins such as phenol resins, melamine resins, epoxy resins, etc., or blocked isocyanates can be added to a blend containing as a main component at least 50% by weight of the mixture of (A) and (B) [a mixture of (A) and (B) as a 95/5 to 50/50 weight ratio of (A)/(B)], in such an amount that bonding is not damaged, in order to improve the characteristic properties of the coils such as heat distortion resistance, resistance to deformation due to moisture absorption, etc.

Furthermore, it is possible to improve characteristic properties as an electric wire by adding one or more plasticizers, silicones, surface active agents, pigments, dyes, organic and inorganic fillers, etc., in an appropriate amount. Such embodiments also fall within the scope of the present invention.

The present invention will be illustrated in detail by several examples hereinbelow, but such are not to be construed as limiting the invention.

EXAMPLE 1

Nylon copolymer (I), a nylon copolymer obtained by copolymerizing 80% laurolactam and 20% ε-caprolactam and which has a reduced viscosity of 1.71 (η sp/C: 0.5% m-cresol solution, at 30°C.: hereafter reduced viscosity is always measured under the same conditions) and nylon copolymer (II), a copolymer obtained by copolymerizing polylaurolactam, ε-caprolactam and hexamethylene diammonium adipate (1:1:1 weight ratio) as nylon copolymer (B), which had an η sp/C of 1.24, were dissolved in a solvent mixture of m-cresol and naphtha (1/1 weight ratio) at a mixing proportion of (I)/(II) of 95/5 (by weight). A coating varnish of 15% concentration was thus prepared. Using a copper wire having a conductor diameter of 0.5 mm. on which a polyester-imide insulating varnish having a heat stability of class H (tradename ISOMID LV, manufactured by Schenectady Chemicals Corporation) was coated six times (4 μ per cent; total thickness 24 82 ) and the varnish prepared as above was further coated twice (6μ per coat; the layer thickness of bonding layer was 12μ); thus the layer thickness of final article (after bonding) was 36μ, baking was conducted at a linear velocity of 10 m./min. in a vertical baking furnace (longitudinal length of 4 m.; retention time was 24 sec.) where the furnace temperatures was 370°C. in the upper portion, 350°C. in the central portion and 250°C. in the lower portion, respectively. A self-bonding magnet wire was thus prepared in a continuous fashion.

EXAMPLES 2, 3, 4 and 5

A self-bonding magnet wire was obtained as in Example 1 except that the mixing proportion of nylon copolymr (I) and nylon copolymer (II) was changed to 90/10, 80/20, 70/30 and 50/50 (weight ratio) in Examples 2, 3, 4 and 5, respectively.

COMPARATIVE EXAMPLE 1

A self-bonding magnet wire was obtained by twice coating a 15% polyvinyl butyral resin (tradename ESLECK BM-1, manufactured by the Sekisui Chemical Co., Ltd.) in a naphtha-m-cresol solvent mixture as in Example 1 onto a polyester-imide insulated electric wire having a conductor diameter of 0.5 mm. (same as in Example 1 ) and then baking in a vertical baking furnace where the furnace temperature was 250°C. in the upper portion, 250°C. in the central portion and 150°C. in the lower portion.

COMPARATIVE EXAMPLE 2

A self-bonding magnet wire was prepared as in Example 1 except that a 15% solution of nylon copolymer (II) alone in the m-cresol-naphtha solvent mixture was used. The thus obtained magnet wire was tacky to bobbins and could not be smoothly wound back from a bobbin.

COMPARATIVE EXAMPLE 3

A self-bonding magnet wire was prepared as in Example 1 except that the mixing ratio of nylon copolymer (I) and nylon copolymer (II) was 30/70. The thus obtained magnet wire was somewhat tacky to bobbins.

COMPARATIVE EXAMPLE 4

A self-bonding magnet wire was prepared as in Example 1 except that a 15% solution of nylon copolymer (I) alone in the m-cresol-naphtha solvent mixture was used. The thus obtained magnet wire was not tacky to bobbins but exhibited low adhesion at a bonding temperature of 160°C.

The bond strength of the self-bonding magnet wires obtained in Examples 1 to 5 and Comparative Examples 1 to 4 was measured according to ASTM-D 2519.

The self-bonding magnet wires were tightly wound around a mandrel 5.0 mm. in diameter to obtain a helical coil of 70 mm. in length. The helical coils obtained were bonded under definite conditions (60°C, 10 minutes). In Table 1, a change in deformation (change in width and bend of a molded deflecting coil (kept at 60°C, 100% RH, 2 days or 7 days; see Table 1 bottom) of 0 to 0.1 mm. is referred to as "0", 0.1 to 0.5 mm. as "+", 0.5 to 1.0 mm. as "++" and greater than 1.0 mm. as "+++", respectively.

The coils obtained by shaping the self-bonding magnet wire of the present invention showed excellent heat distortion resistance and resistance to deformation due to moisture absorption.

The self-bonding magnet wire of the present invention exhibits excellent mechanical properties such as windability, windability after rapid stretching, abrasion resistance, resistance to deterioration in processing, etc., and, in addition, exhibits good thermal properties such as heat-shock resistance, resistance to deterioration due to heating, etc., which are not exhibited by conventional self-bonding magnet wires.

Table 1

| | Example 1 | Example 2 | Example 3 | Example 4 | Example 5 | Comparative Example 1 | Comparative Example 2 | Comparative Example 3 | Comparative Example 4 |
|---|---|---|---|---|---|---|---|---|---|
| Nylon copolymer (I) | 95 | 90 | 80 | 70 | 50 | | | 30 | 100 |
| Nylon copolymer (II) | 5 | 10 | 20 | 30 | 50 | | 100 | 70 | |
| Polyvinyl butyral | | | | | | 100 | | | |
| Bond Strength after fusion at 160°C | | | | | | | | | |

Table 1-continued

| | Example 1 | Example 2 | Example 3 | Example 4 | Example 5 | Comparative Example 1 | Comparative Example 2 | Comparative Example 3 | Comparative Example 4 |
|---|---|---|---|---|---|---|---|---|---|
| for 10 mins. Measured at Room Temperature (kg.) | 3.8 | 4.5 | 4.6 | 4.6 | 4.2 | 5.7 | 3.2 | 3.0 | 1.9 |
| Measured at 130°C (g.) | 570 | 620 | 570 | 560 | 320 | 40 | 70 | 130 | — |
| Tackiness of wires to a Bobbin | None | None | None | None | None | None | Positive | Positive | None |
| Heat Distortion of Coil | | | | | | | | | |
| Aged at 130°C for Deformation of Coil due to Moisture Absorption 60°C, 100% RH | 0 | 0 | 0 | 0 | + | +++ | +++ | ++ | — |
| 2 Days | 0 | 0 | 0 | 0 | 0 | | | | |
| 7 Days | 0 | 0 | 0 | + | ++ | | | | |

While the invention has been described in detail and with reference to specific embodiments thereof, it will be apparent to one skilled in the art that various changes and modifications can be made therein without departing from the spirit and scope thereof.

What is claimed is:

1. A self-bonding magnet wire comprising a conductor core, an insulating intermediate layer and an outer layer of a baked mixture of nylon copolymer (A) and nylon copolymer (B), where the proportion of nylon copolymer (A) and nylon copolymer (B) is 50 – 95 parts of (A) to 50 to 5 parts of (B) (by weight), nylon copolymer (A) being alcohol-insoluble and non-swellable by an alsohol at room temperature and containing nylon-12, and nylon copolymer (B) having a lower melting point than that of the nylon copolymer (A).

2. The self-bonding magnet wire according to claim 1, comprising as nylon copolymer (A) a nylon copolymer containing 60 – 90 % by weight of nylon-12.

3. The self-bonding magnet wire according to claim 1, comprising as nylon copolymer (A) a nylon copolymer containing 75 – 85 % by weight of nylon-12.

4. The self-bonding magnet wire according to claim 1, comprising as nylon copolymer (A) a nylon copolymer of nylon-12 and nylon-6.

5. The self-bonding magnet wire according to claim 1, comprising as nylon copolymer (A) a nylon copolymer containing 80% by weight of nylon-12 and 20% by weight of nylon-6.

6. The self-bonding magnet wire according to claim 1, comprising as nylon copolymer (B) a nylon copolymer containing 10 – 50 % by weight of nylon-12.

7. The self-bonding magnet wire according to claim 1, comprising as nylon copolymer (B) a nylon-6/nylon-6,6/nylon-12 copolymer containing 10 – 50 % by weight of nylon-12.

8. The self-bonding magnet wire according to claim 1, comprising as nylon copolymer (B) a nylon-6/nylon-6,10/nylon-12 copolymer containing 10 – 50 % by weight of nylon-12.

9. The self-bonding magnet wire according to claim 1, comprising as nylon copolymer (B) a nylon-6/nylon-6,6/nylon-12 copolymer at a weight ratio of nylon-6 : nylon-6,6 : nylon-12 of 1 : 1 : 1.

10. A coil for use as a yoke coil for television sets comprising the self-bonding magnet wire according to claim 1.

11. A process for forming a self-bonding magnet wire according to claim 1 which comprises:

coating an insulating layer-coated conductor with a mixture of nylon copolymer (A) and nylon copolymer (B) where the proportions of nylon copolymer (A) and nylon copolymer (B) is 50 – 95 parts of (A) to 50 to 5 parts of (B) (by weight), nylon copolymer (A) being alcohol-insoluble and non-swellable by an alcohol at room temperature and containing nylon-12, and nylon copolymer (B) having a lower melting point than that of the nylon copolymer (A); and baking the thus coated conductor.

* * * * *